US006260212B1

(12) United States Patent
Orotelli et al.

(10) Patent No.: US 6,260,212 B1
(45) Date of Patent: Jul. 17, 2001

(54) HEAD-PROTECTIVE HELMET WITH GEODESIC DOME

(75) Inventors: Louis Orotelli, Clark; Kerry W. Gordon, Mendham, both of NJ (US)

(73) Assignee: Mine Safety Appliances Company, Pittsburgh, PA (US)

( * ) Notice: Subject to any disclaimer, the term of this patent is extended or adjusted under 35 U.S.C. 154(b) by 0 days.

(21) Appl. No.: 09/415,080

(22) Filed: Oct. 12, 1999

(51) Int. Cl.[7] ..... A42B 1/06
(52) U.S. Cl. ..... 2/410; 2/5
(58) Field of Search ..... 2/410, 5, 6.1, 6.6, 2/411, 412

(56) References Cited

U.S. PATENT DOCUMENTS 1,280,322 * 10/1918 Soren ..... 2/6.6
3,447,163 * 6/1969 Bothwell et al. ..... 2/412
3,616,463 * 11/1971 Theodore et al. ..... 2/412
3,958,276 * 5/1976 Clausen ..... 2/2.5
4,564,959 * 1/1986 Zahn ..... 2/411
4,724,549 * 2/1988 Herder et al. ..... 2/411
5,524,641 * 6/1996 Battaglia ..... 2/462 X
5,561,866 * 10/1996 Ross ..... 2/410
5,956,777 * 9/1999 Popovich ..... 2/412 X
5,978,961 * 11/1999 Barker ..... 2/2.5

* cited by examiner

*Primary Examiner*—Rodney Lindsey
(74) *Attorney, Agent, or Firm*—R. Gale Rhodes, Jr.; James G. Uber

(57) ABSTRACT

A head-protective helmet comprising a geodesic dome. A further feature is the geodesic dome in combination with other elements providing a head-protective helmet.

18 Claims, 7 Drawing Sheets

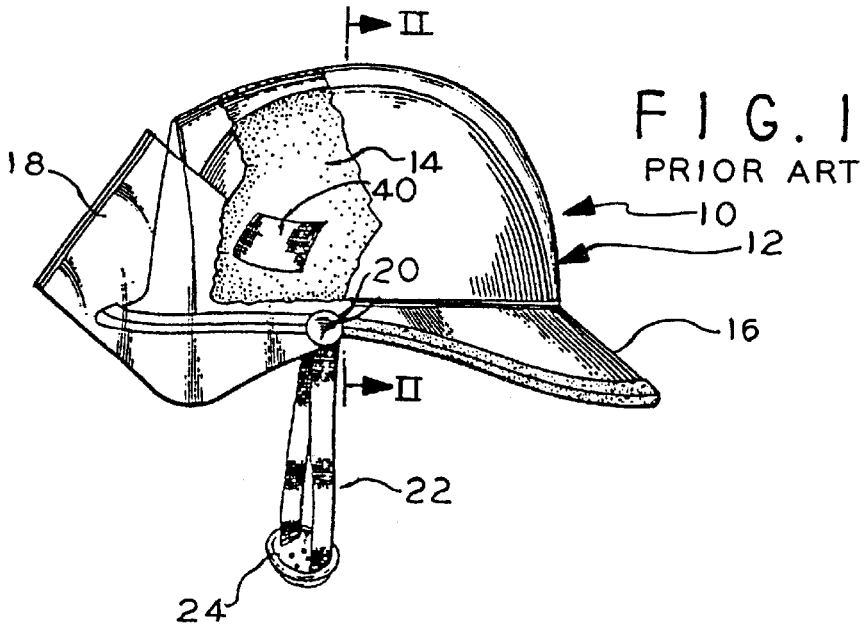
FIG. 1
PRIOR ART
FIG. 2
PRIOR ART
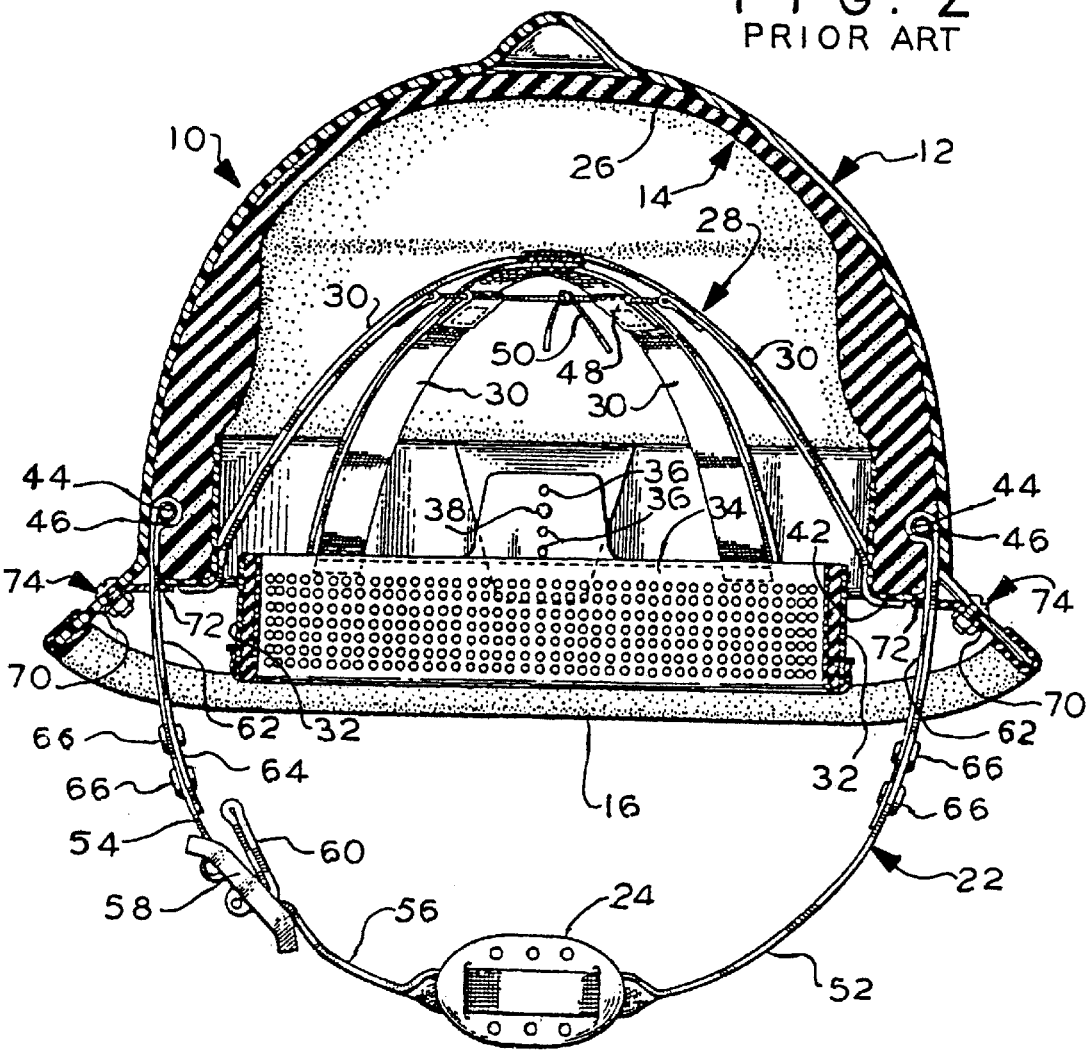

FIG. 4
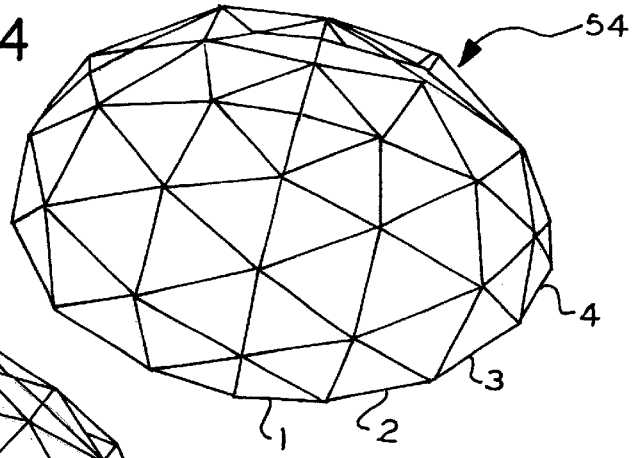
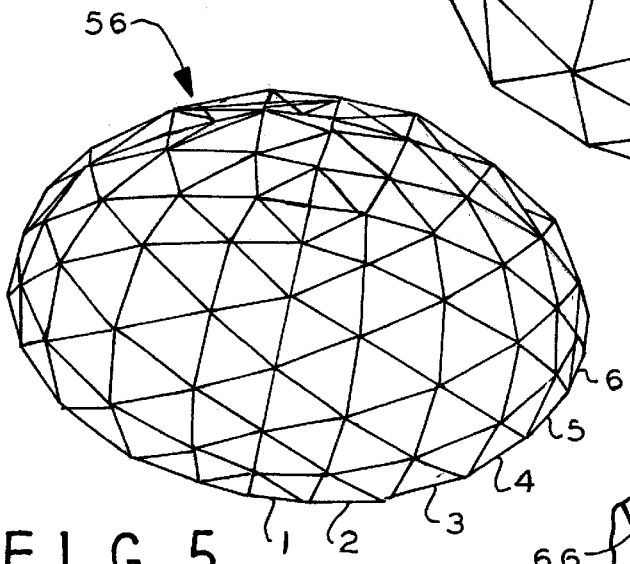
FIG. 5
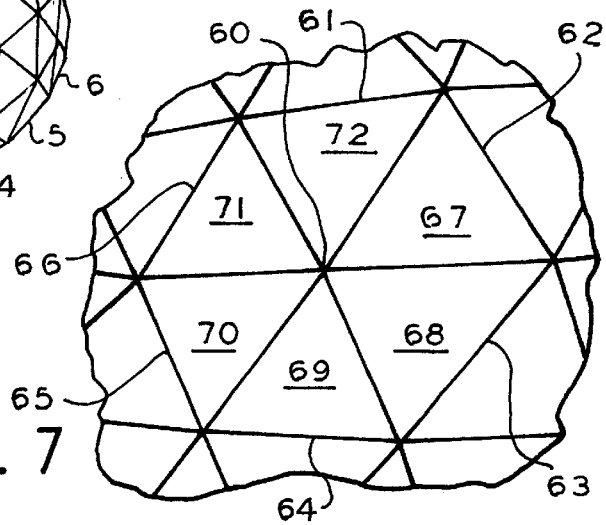
FIG. 7
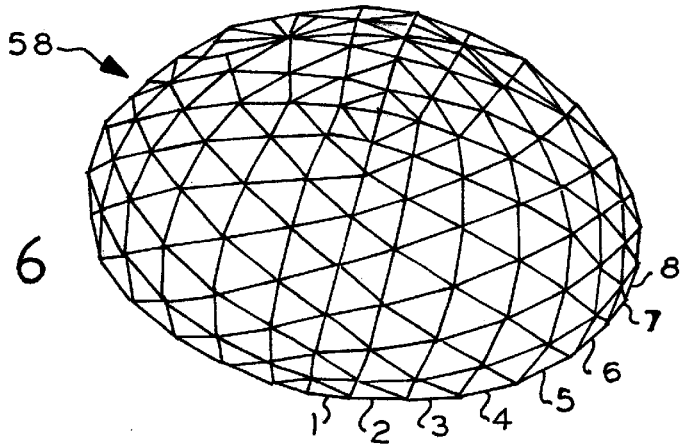
FIG. 6

HEAD-PROTECTIVE HELMET WITH GEODESIC DOME

BACKGROUND OF THE INVENTION

This invention relates to a head-protective helmet including a geodesic dome. Further, this invention relates to a geodesic dome in combination with other elements comprising a head-protective helmet.

Numerous head-protective helmets are known to the art, such as, by way of example and not by way of limitation, firefighters, helmets, industrial helmets (sometimes referred to as hard hats), fighter pilot helmets, and other military helmets.

An example of a firefighter's head-protective helmet is disclosed in U.S. Pat. No. 5,044,016 entitled PROTECTIVE HELMET ASSEMBLY INCLUDING RELEASABLE HEAD RETAINING ASSEMBLY, patented Sep. 3, 1991, Christopher E. Coombs, inventor. This patent is assigned to the same assignee as the present application, and this patent is hereby incorporated herein by reference as if fully reproduced herein. FIGS. 1 and 2 of this incorporated patent are reproduced herein as FIGS. 1 and 2. Referring to FIG. 1, the head-protective helmet is indicated by general numerical designation 10 and includes an outer shell 12, sometimes referred to as the hard shell, an attenuation liner assembly 14, a brim 16 circumscribing the outer shell 12, a pivotally mounted transparent visor 18, a chin strap 22 including a chin cup 24. The attenuation liner assembly 14, FIG. 2, includes a non-resilient foam liner 26, sometimes referred to as an inner impact cap, frictionally fitted within the outer shell 12, with the exterior of the foam liner 26 corresponding to the interior surface of the outer shell 12. The foam liner or inner impact cap 26 is retained frictionally within the outer shell 12 with such frictional retention being augmented by the cooperating patches of hook and loop fastener material generally indicated as 40 in FIG. 1. The non-resilient foam liner 26, or inner impact cap, is for absorbing force or energy applied to the helmet 10 by being compressed which attenuates force or energy that would otherwise be transferred to the head of the wearer of the helmet upon, for example, a falling object striking the head-protective helmet 10. The outer shell 12 typically is made of a hard plastic such as a suitable high temperature thermoset which may be filled with glass or other fibers for increased strength, and the inner impact cap 26 typically is made of a suitable non-resilient or compressible material such as, for example, rigid polyurethane foam.

While the head-protective helmets known to the art, such as the firefighter's helmet disclosed in the incorporated patent and shown in FIG. 1, have worked well for their intended purpose, there still exists a need in the head-protective helmet art for a head-protective helmet providing increased protection against force or energy that would be applied to the head of the helmet wearer, such as by falling objects. Also there is a further need in the head-protective helmet art for a head-protective helmet providing increased resistance against a falling object penetrating the helmet and striking the head of a wearer of the helmet.

SUMMARY OF THE INVENTION

It is the object of the present invention to satisfy the foregoing need in the art.

A head-protective helmet satisfying such need and embodying the present invention is a head-protective helmet comprising a geodesic dome. A further feature of the present invention is the geodesic dome in combination with other elements comprising a head-protective helmet.

DESCRIPTION OF THE DRAWINGS

FIG. 1 is a side view of a prior art firefighter's head-protective helmet;

FIG. 2 is an enlarged cross-sectional view taken generally along the line II—II in FIG. 1 in the direction of the arrows;

FIG. 4 is a perspective view of an octagonal geodesic dome having a frequency of 4;

FIG. 5 is a perspective view of an octagonal geodesic dome having a frequency of 6;

FIG. 6 is a perspective view of an octagonal geodesic dome having a frequency of 8;

FIG. 7 is an enlarged view of a portion of FIG. 6;

DETAILED DESCRIPTION OF THE INVENTION

The present invention will be described in the context of a firefighter's head-protective helmet, but it will be understood that such is merely by way of illustration and not by way of limitation and that the present invention is capable of being embodied in other head-protective helmets known to the art.

Figure 3:
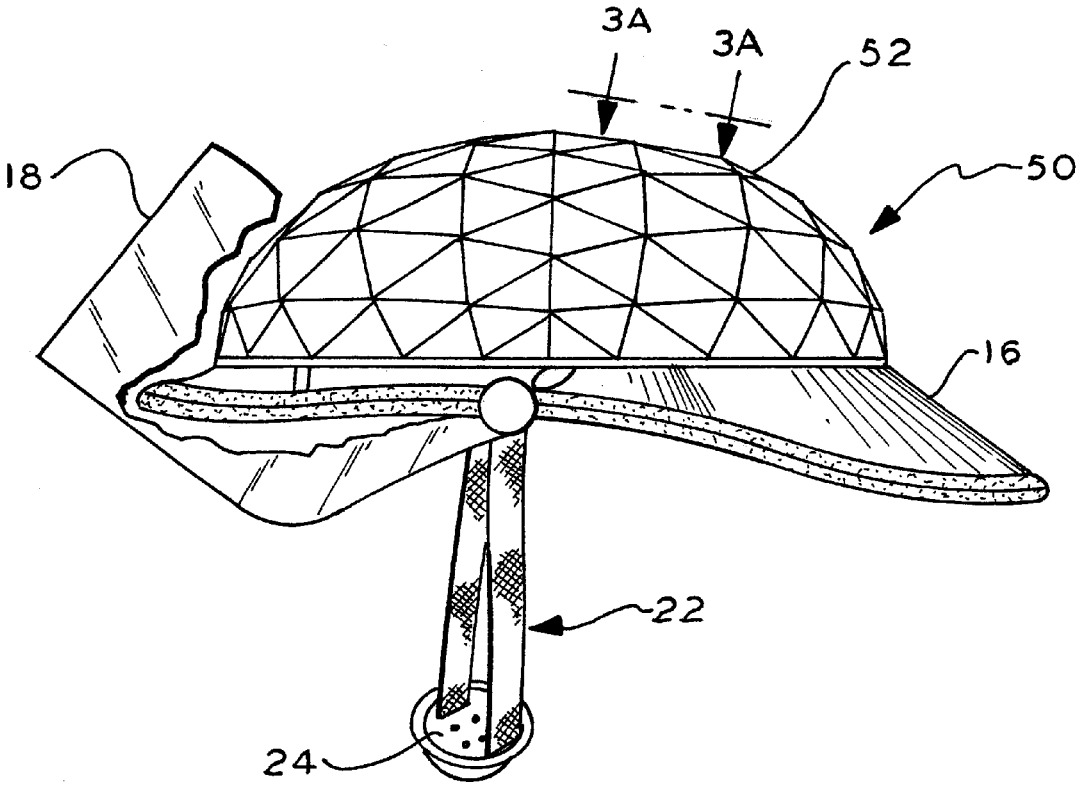
FIG. 3 is a side view of a head-protective helmet of the present invention embodying a geodesic dome.

Referring to FIG. 3, there is shown a firefighter's head-protective helmet embodying the present invention which is indicated by general numerical designation 50. The firefighter's helmet 50 includes a geodesic dome 52 and may include the brim 16, visor 18, and chin strap and chin cup 24 shown in FIG. 1 and described in the Background of the Invention.

Geodesic domes, such as geodesic dome 52 in FIG. 3, are one-half, or hemispheres, of geodesic spheres. Geodesic spheres are three dimensional polyhedrons having repeating geodesic patterns. For example, an octagonal geodesic sphere has eight repeating sectors or quadrants. A hemisphere, or one-half, of a geodesic sphere is referred to or defined in the context of the geodesic sphere of which it comprises a half or a hemisphere, and hence a hemisphere, or one-half, of an octagonal geodesic sphere is referred to as an octagonal geodesic dome even though it only comprises four, not eight, of the repeating sectors or quadrants. In addition to being defined geometrically, geodesic domes are also defined in terms of a frequency. Frequency refers to the number of pieces that each edge of the base figure, of the geodesic pattern, is divided into in the process of triangulating its sides. Triangulation means the process of subdividing a triangle into smaller triangles.

Referring to FIG. 4, there is shown an octagonal geodesic dome indicated by general numerical designation 54 which has a frequency of 4, with the 4 edges defining the frequency being identified in FIG. 4 by numerical designations 1–4. Shown in FIG. 5 is an octagonal geodesic dome indicated by general numerical designation 56 and which dome has a frequency of 6 with the 6 edges of the dome defining such frequency being identified by numerical designations 1–6. FIG. 6 illustrates an octagonal geodesic dome identified by general numerical designation 58 and which dome has a frequency of 8 with its 8 edges defining such frequency being identified in FIG. 6 by numerical designations 1–8. The geodesic dome 52 shown in FIG. 3 comprising the firefighter's head-protective helmet 50 is an octagonal geodesic dome having a frequency of 6 the same as the geodesic dome 56 shown in FIG. 5. As will be understood from FIG. 7, an enlarged portion of FIG. 5, the geodesic patterns are defined by a vertex 60, edges 61–66 and faces or facets 67–72. The geodesic domes of the present invention may be made of polycarbonate, and may be made by suitable molding techniques known to the art.

Figure 8:
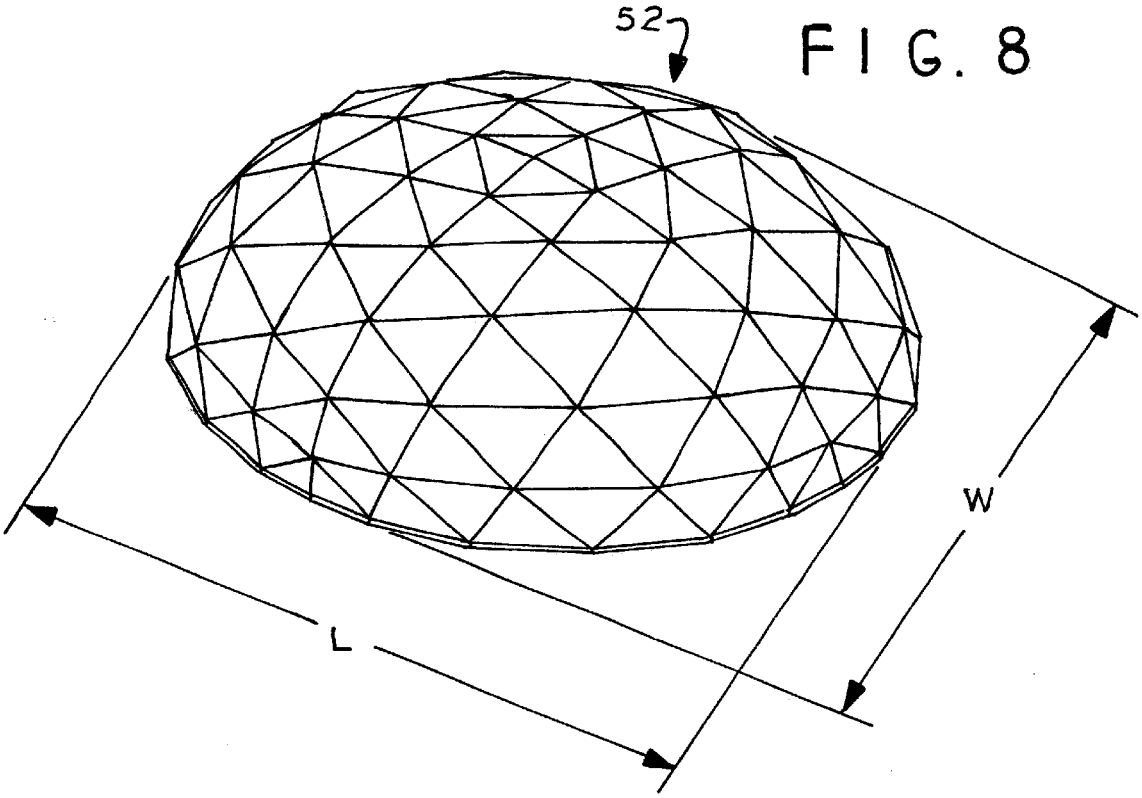
FIG. 8 is a perspective view of the geodesic dome of FIG. 5 showing its length and width.
Figure 9:
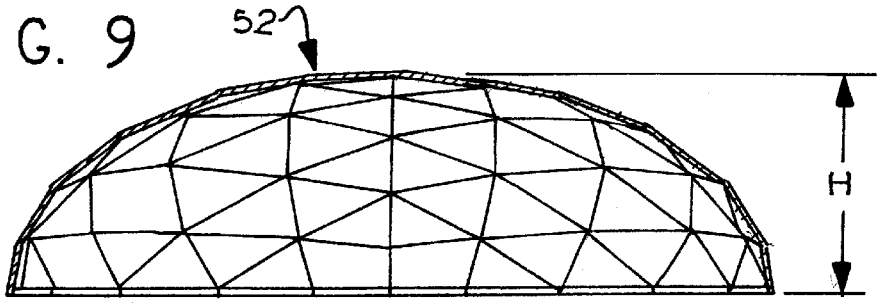
FIG. 9 is a cross-sectional view of the geodesic dome shown in FIGS. 5 and 8 showing its height.
Figure 10:
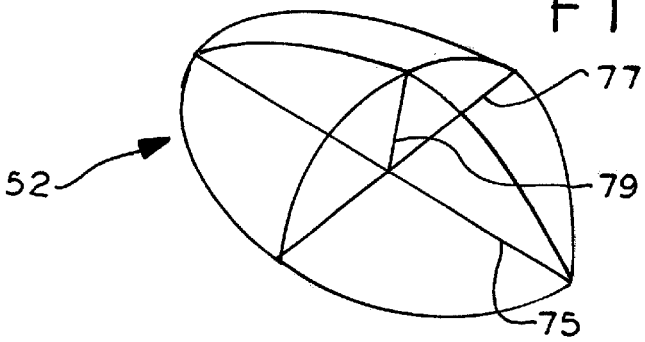
FIG. 10 is a diagrammatical illustration of the three planes of symmetry of the geodesic dome shown in FIGS. 5 and 8.

Geodesic dome 52 from FIG. 3 is shown separately in FIGS. 8 and 9 and is illustrated diagrammatically in FIG. 10. From FIGS. 8 and 9, it will be understood that the geodesic dome 52 has a length L and a width W. From FIG. 9, it will be understood that the geodesic dome 52 has a height H. It will be further understood from FIGS. 8 and 9 that the length L is greater than the width W and the width W is greater than the height H. Accordingly, it will be understood from these FIGS. that the geodesic dome 52 is an oblate hemispherical geodesic dome.

From FIG. 10, it will be understood that the geodesic dome 52 has a major axis 75 along its maximum length, a first minor or secondary axis 77 along its maximum width, and a second minor or tertiary axis 79 along its maximum height.

Figure 11:
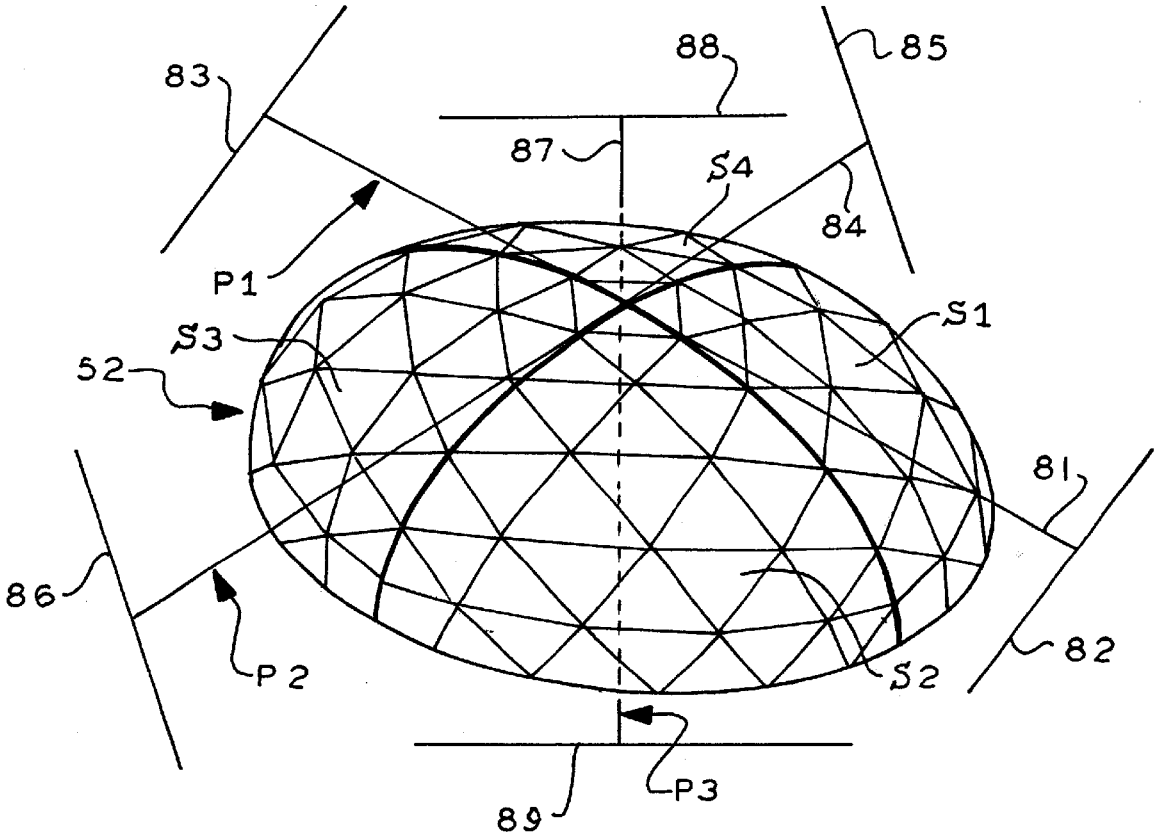
FIG. 11 is a perspective view of the geodesic dome shown in FIGS. 5 and 8 and illustrating the symmetry of the hemispherical quadrants or sectors.

Referring to FIG. 11, it will be understood that the geodesic dome 52 is comprised of four spherically shaped, or hemispherical, quadrants or sectors S1, S2, S3 and S4. The dome 52 has three planes of symmetry. The first plane of symmetry, indicated in FIG. 11 by general designation P1 extends along the length of the dome and is indicated by the lines 81, 82 and 83. The second plane of symmetry, indicated in FIG. 11 by general designation P2, extends through the maximum width of the dome 52 as indicated by lines 84, 85 and 86, and the third plane of symmetry, indicated in FIG. 11 by general designation 13, extends through or is coincident with the bottom edge of the dome 52 and is illustrated in FIG. 11 by lines 87, 88 and 89. It will be noted from FIG. 11 that the sectors S1 and S4 are symmetrical with respect to sectors S2 and S3 and with respect to the plane of symmetry indicated by lines 81, 82 and 83. Sectors S1 and S2 are symmetrical with respect to sectors S3 and S4 and with respect to the plane of symmetry indicated by lines 84, 85 and 86. The sectors S1, S2, S3 and S4 are symmetrical with respect to each other and with respect to the planes indicated by lines 87, 88 and 89. Accordingly, from FIG. 10 it will be understood that the geodesic dome 52 is an oblate hemispherical geodesic dome having respective unequal major, minor and tertiary axes 74, 77 and 79, and from FIG. 11 it will be understood that the oblate hemispherical geodesic dome 52 has three planes of symmetry P1, P2 and P3.

Figure 12:
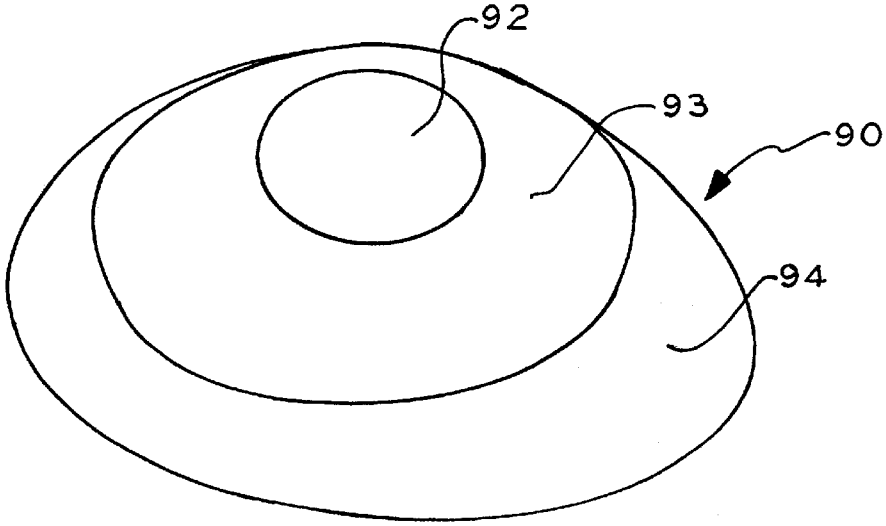
FIG. 12 is a perspective diagrammatical illustration of an alternate embodiment of the geodesic dome of the present invention.

Another embodiment of the geodesic dome which may comprise the head-protective helmet of the present invention is illustrated in FIG. 12 and identified by general numerical designation 90. Geodesic dome 90 includes a central portion 92, a first annular portion 93 generally concentric with and surrounding the central portion 92, and a second annular portion 94 formed generally concentrically with and surrounding the first annular portion 93; the portions 92, 93 and 94 are formed integrally such as by molding. In this embodiment, the central portion 92 and the annular portions 93 and 94 may each be of a different geodesic dome pattern and frequency. For example, the central portion 92 may be comprised of the central portion of the octagonal geodesic dome 54 shown in FIG. 4 having a frequency of 4, the first annular portion 93 may be comprised of an annular portion of the octagonal geodesic dome 56 shown in FIG. 5 having a frequency of 6 and the second annular portion 94 may be comprised of an annular portion of the octagonal geodesic dome 58 shown in FIG. 6 having a frequency of 8.

Figure 13:
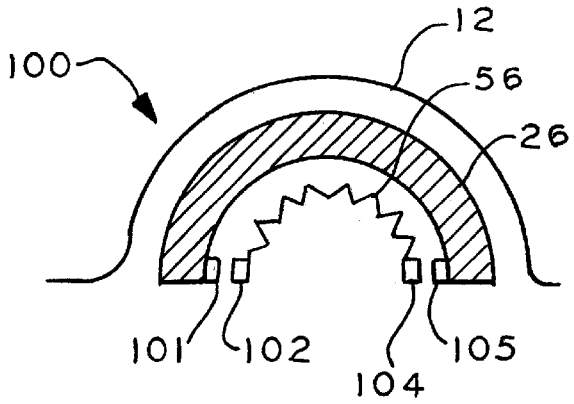
FIGS. 13–16 are diagrammatical, generally transverse cross-sectional views, of further alternate embodiments of the head-protective helmet of the present invention embodying one or more geodesic domes.

Further alternate embodiments of the head-protective helmet of the present invention, which may be embodied as a firefighter's head-protective helmet, are shown respectively in FIGS. 13–16. In these FIGS., the outer shell 12 and inner impact cap 26 shown respectively in FIGS. 1 and 2 are illustrated diagrammatically and given the same numerical designations. The head-protective helmet shown in FIG. 13 is indicated by general numerical designation 100 and in addition to the outer shell 12 and inner impact cap 26, this head-protective helmet includes a geodesic dome which may be the geodesic dome 56 shown in FIG. 5 and described above. The geodesic dome 56 is indicated diagrammatically by the irregular line in FIG. 13 and is identified by numerical designation 56; the geodesic dome 56 resides interiorly of the inner impact cap 26. Geodesic dome 56 may be mounted releasably to the inner impact cap 26 by cooperating pairs of patches of hook and loop material illustrated diagrammatically in FIG. 13 and identified by pairs of numerical designations 101 and 102 and 104 and 105.

Figure 14:
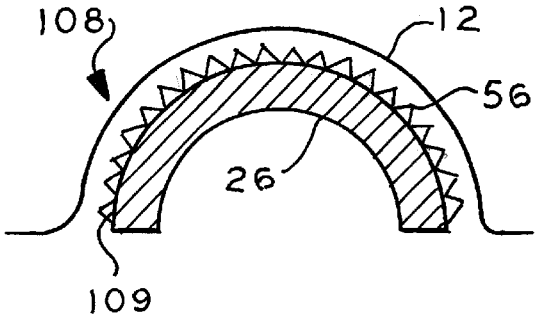

The alternate embodiment of the head-protective helmet of the present invention illustrated in FIG. 14 is identified by general numerical designation 108 and includes the outer shell 12, inner impact cap 26 which includes an outer surface 109 to which a geodesic dome, such as the geodesic dome 56 of FIG. 5, is suitably mounted; geodesic dome 56 is illustrated diagrammatically in FIG. 14 by the irregular line identified by numerical designation 56. Upon, for example, the inner impact cap 26 being made of a high temperature polyurethane foam, and upon the geodesic dome 56 being made of polycarbonate, geodesic dome 56 may be bonded to the outer surface of the inner impact cap 26 by a suitable adhesive known to the art for bonding plastic parts together.

Figure 15:
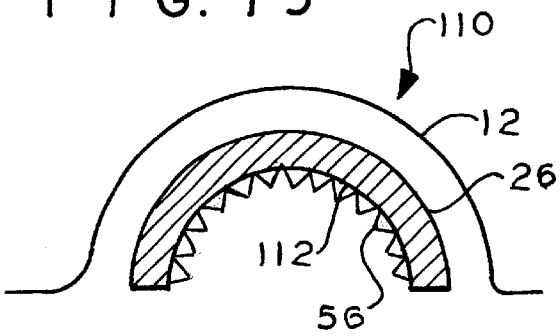

A still further alternate embodiment of the head-protective helmet of the present invention is illustrated diagrammatically in FIG. 15 and is indicated by general numerical designation 110. The helmet 110 includes the outer shell 12, inner impact cap 26, and a geodesic dome which may be the geodesic dome 56 shown in FIG. 5 which is illustrated diagrammatically in FIG. 15 by the irregular line identified by numerical designation 56. Geodesic dome 56 is suitably mounted to the inner surface 112 of the inner impact cap 26. Upon the inner impact cap 14 being made of high temperature polyurethane foam and upon the geodesic dome 56 being made of polycarbonate, the geodesic dome 56 may be bonded to the inner impact cap 26 by a suitable adhesive known to the art for bonding plastic parts together.

Figure 16:
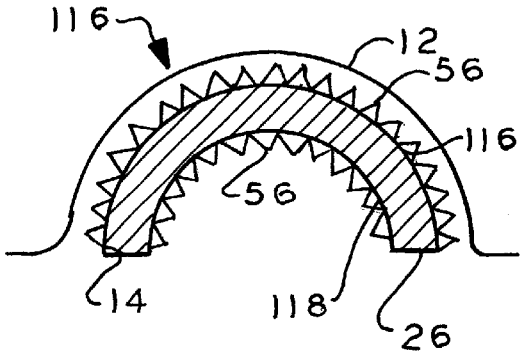

A still further alternate embodiment of the head-protective helmet of the present invention is illustrated in FIG. 16 and indicated by general numerical designation 116. Helmet 116 includes the outer shell 12, inner impact cap 26 having an outer surface 116 to which a geodesic dome 56 is suitably mounted and an inner surface 118 to which a second geodesic dome 56 is suitably mounted; the geodesic domes 56 are indicated diagrammatically in FIG. 16 by the irregular lines and each may be, for example, the geodesic dome 56 shown in FIG. 5. As with regard to the helmet embodiments 108 and 110 illustrated respectively in FIGS. 14 and 15, upon the inner impact cap 26 being made of high temperature polyurethane foam and the geodesic domes 56 being made of polycarbonate, the domes may be bonded to the inner impact cap 26 by a suitable adhesive known to the art for bonding plastic parts together.

Figure 17:
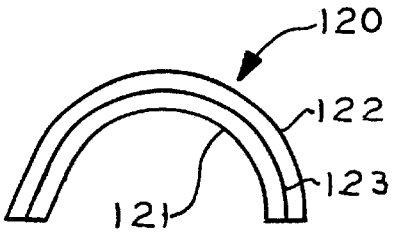
FIG. 17 is a diagrammatical illustration of an alternate embodiment of the head-protective helmet of the present invention embodying vertically stacked geodesic domes.
Figure 18:
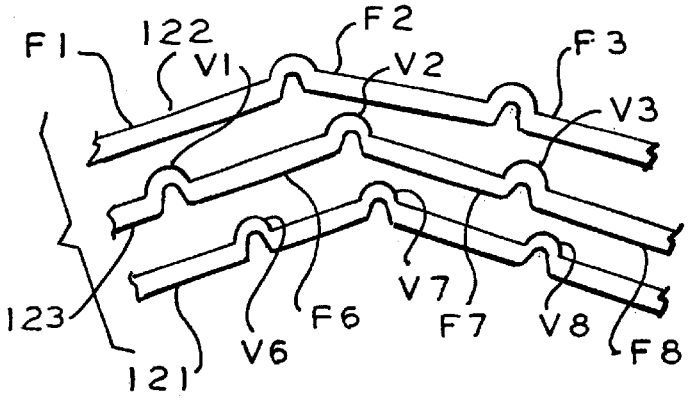
FIG. 18 is an enlarged partial diagrammatical view showing detailed structure of the stacked geodesic domes shown in FIG. 17.
Figure 19:
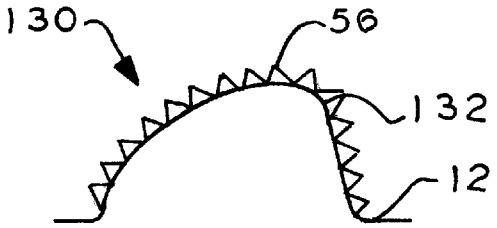
FIGS. 19–21 are diagrammatical illustrations of still further alternate embodiments of the head-protective helmet of the present invention embodying one or more geodesic domes.

A further embodiment of a geodesic dome, a composite geodesic dome, which may comprise a head-protective helmet of the present invention is illustrated diagrammatically in FIG. 17 and indicated by general numerical designation 120. Composite geodesic dome 120 includes a first or innermost geodesic dome 121, an outermost geodesic dome 122, and an intermediate geodesic dome 123; although only one intermediate geodesic dome 123 is shown in FIG. 17, it will be understood that in accordance with the teachings of the present invention a plurality of intermediate geodesic domes may be utilized. It will be understood from FIG. 18 that the geodesic domes 121, 122 and 123 comprising the composite geodesic dome 120 are stacked and spaced apart and that such geodesic domes increase in size outwardly from the innermost geodesic dome to the outermost geodesic dome. These geodesic domes may be each a geodesic dome, but of different size, of the types disclosed in FIGS. 5, 6 and 6 and described above. The bottom edges of the geodesic domes 121, 122 and 123 reside generally in a common plane and are bonded together and upon such geodesic domes being made of polycarbonate, it will be understood that their bottom edges are bonded together with a common bonding material of the type known to the art for bonding plastic parts together. Portions of the geodesic domes 121, 122 and 123 shown in FIG. 18 are shown in FIG. 19. It will be understood that in accordance with the further teachings of the present invention these stacked geodesic domes may be stacked such that the vertices of each geodesic dome are aligned with the faces of the next adjacent geodesic dome. This provides the composite geodesic dome 120 with further force and penetration resistance. More particularly, it will be noted from FIG. 18 that the vertices V1, V2 and V3 of geodesic dome 123 are aligned or oppose the faces F1, F2 and F3 of adjacent geodesic dome 122 and that the vertices V6, V7 and V8 of geodesic dome 121 are opposite the faces F6, F7 and F8 of adjacent geodesic dome 123.

Figure 20:
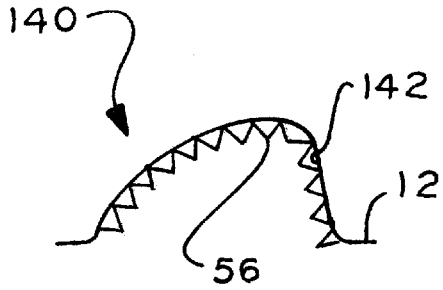
Figure 21:
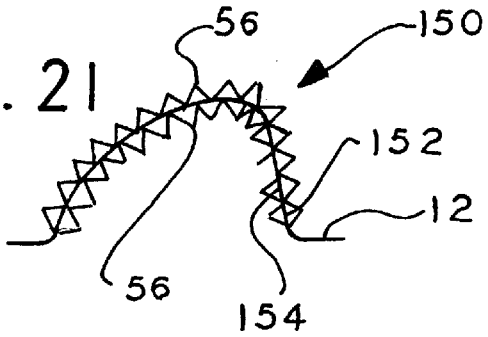

Still further alternate embodiments of the head-protective helmets of the present invention which may be embodied as a firefighter's head-protective helmet are illustrated diagrammatically in FIGS. 19, 20 and 21 and identified, respectively, by general numerical designations 130, 140 and 150. The head-protective helmets illustrated in these FIGS. comprise the shell 12 from FIG. 1 with the shell 12 being shown in these FIGS. diagrammatically and identified by numerical designation 12. In FIG. 19, the shell 12 of the head-protective helmet 130 includes an outer surface 132 to which a geodesic dome 56 is bonded. The geodesic dome is illustrated diagrammatically by the irregular line in FIG. 20 and may be, for example, the geodesic dome 56 shown in FIG. 5 and described above. The shell 12 of the head-protective helmet 140 of FIG. 20 includes an inner surface 142 to which a geodesic dome, such as geodesic dome 56 of FIG. 5, is suitably mounted. In the head-protective helmet 150 illustrated in FIG. 22, includes the shell 12 includes an outer surface 152 and an inner surface 154 and geodesic domes 56 are bonded to both the outer surface 152 and the inner surface 154. These geodesic domes may be the geodesic dome 56 illustrated in FIG. 5 and are so identified in FIG. 21. Upon the shell 12 shown in FIGS. 20–22 being made of a high temperature polycarbonate and upon the geodesic domes 56 being made of polycarbonate, the geodesic domes 56 may be bonded to the respective inner and outer surfaces of the shell 12 by suitable bonding agents known to the art for bonding plastic parts together. The shells 12 shown in FIGS. 18–20 may be provided with a visor and chin strap such as the visor 18 and chin strap 22 shown in FIGS. 1 and 2.

Figure 22:
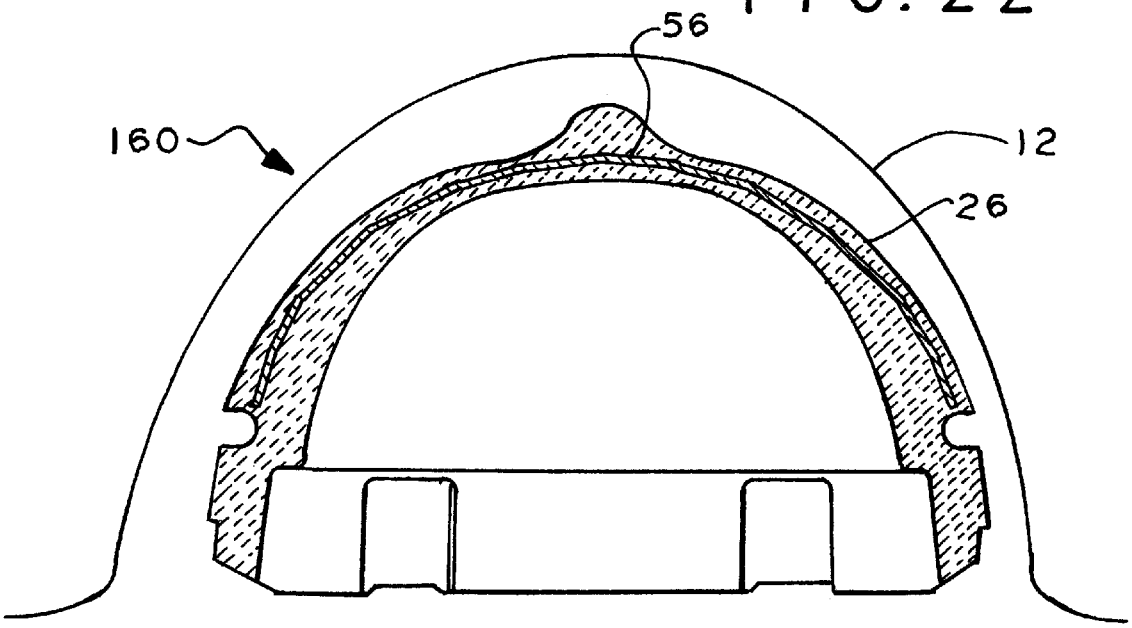
FIG. 22 is a cross-sectional view showing a geodesic dome molded interiorly of an inner impact cap of a head-protective helmet embodying the present invention.

Referring now to FIG. 22, a further embodiment of the head-protective helmet of the present invention is illustrated including the outer shell 12 and an inner impact cap 26 which is molded around a geodesic dome such as the geodesic dome 56 shown in FIG. 5. The inner impact cap 26, as noted above, may be molded from high temperature polyurethane foam and in accordance with the teachings of the present invention such impact cap 26 may be molded around the geodesic dome 52 to provide the inner impact cap with increased resistance to force and penetration.

Figure 3A:
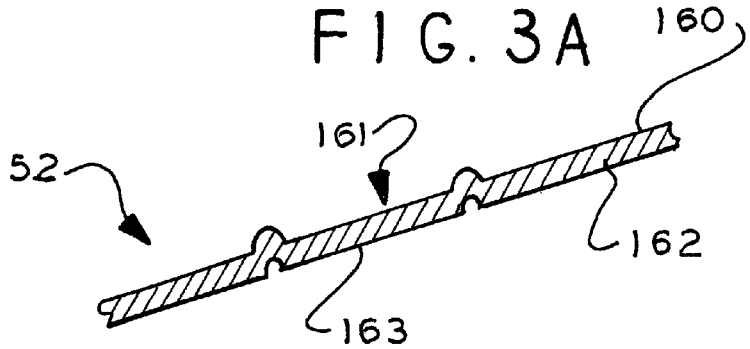
FIG. 3A is an enlarged cross-sectional view taken generally along the line 3—3 in FIG. 3 in the direction of the arrows.

Referring to FIG. 3A, it will be understood that the geodesic dome 52 of the invention embodiment illustrated in FIG. 3 may include an outer surface 160 having a geodesic dome pattern indicated by general numerical designation 161 molded thereon and an inner surface 162 having the same geodesic dome pattern molded therein and indicated by general numerical designation 163. The geodesic dome 52, as noted above, may be made of molded high temperature polycarbonate, and the geodesic dome pattern 161 molded in the outer surface 160 may be molded thereon by embossing providing a raised geodesic dome pattern 163 and the geodesic dome pattern molded into the inner surface 162 may be molded therein by intaglio to provide the inner surface 162 with the geodesic dome pattern in relief or indentation.

Referring again to the head-protective helmet embodiment of the present invention illustrated in FIGS. 3, 17, and 19–21, it will be understood that such head-protective helmet embodiments may include an inner impact cap such as the inner impact cap 26 shown in FIG. 2 and suitable head mounting components for mounting such helmets to the head of the helmet wearer and which head mounting components may be, for example, the cradle 28 of a plurality of web straps 30 and an adjustable head band 32 including the sweat band 34 shown in FIG. 2. It will be still further understood that the head-protective helmet embodiments of the present invention illustrated in FIGS. 13–16 and 22 may be provided with suitable components for mounting such helmets to the head of a helmet wearer such as, for example, the cradle 28 of the plurality of web straps 30 and the adjustable head band 32 including the sweat band 34 shown in FIG. 2.

It will be understood that the head-protective helmet of the present invention embodying a geodesic dome provides improved protection to the head of a wearer of the helmet against force or energy applied to the helmet, such as by a falling object striking the helmet, and provides improved protection against such falling object penetrating the helmet.

It will be understood by those skilled in the art that many modifications and variations may be made in the present invention without departing from the spirit and the scope thereof.

What is claimed is:

1. Head-protective helmet, comprising:

a head-protective shell having an inner surface and an outer surface, a first geodesic dome found on said outer surface and a second geodesic dome found in said inner surface.

2. The head-protective helmet according to claim 1 wherein said geodesic dome is an octagonal geodesic dome having a frequency of 4.

3. The head-protective helmet according to claim 1 wherein said geodesic dome is an octagonal geodesic dome having a frequency of 6.

4. The head-protective helmet according to claim 1 wherein said geodesic dome is an octagonal geodesic dome having a frequency of 8.

5. The head-protective helmet according to claim 1 wherein said geodesic dome is a generally oblate hemispherical geodesic dome.

6. The head-protective helmet according to claim 1 wherein said geodesic dome is circumscribed by a helmet brim.

7. The head-protective helmet according to claim 1 wherein said geodesic dome is a hemispherical geodesic dome having three planes of symmetry and having unequal major, minor, and tertiary axes.

8. Head-protective helmet, comprising:

a geodesic dome; and an outer shell and an inner impact cap having an interior and said geodesic dome mounted to said interior of said impact cap.

9. Head-protective helmet, comprising:

a geodesic dome; and a head-protective outer shell and an inner impact cap having an inner surface and said geodesic dome being bonded to said inner surface.

10. The head-protective helmet according to claim 9 wherein said inner impact cap includes an outer surface and wherein said head-protective helmet includes a second geodesic dome bonded to said outer surface.

11. Head-protective helmet, comprising:

a geodesic dome; and an outer shell and an inner impact cap having an outer surface and said geodesic dome being bonded to said outer surface.

12. Head-protective helmet, comprising:

a geodesic dome; and an outer shell and an inner impact cap of molded material molded around said geodesic dome to cause said geodesic dome to reside interiorly of said inner impact cap.

13. Head-protective helmet, comprising:

a plurality of stacked geodesic domes including an innermost geodesic dome, an outermost geodesic dome and at least one intermediate geodesic dome, said plurality of geodesic domes increasing in size from said innermost geodesic dome to said outermost geodesic dome.

14. The head-protective helmet according to claim 13 wherein said plurality of geodesic domes have bottom edges generally residing in a common plane and wherein said bottom edges are generally bonded together in said common plane.

15. The head-protective helmet according to claim 13 wherein each geodesic dome of said plurality of geodesic domes includes a plurality of vertices, edges, and faces, and wherein the vertices of each geodesic dome are aligned with the faces of the next adjacent geodesic dome.

16. Head-protective helmet, comprising:

a geodesic dome, said geodesic dome including a central geodesic dome portion, a second annular geodesic dome portion immediately surrounding and integral with said central geodesic dome portion and a third annular geodesic dome portion immediately surrounding and integral with said second annular geodesic dome portion, said central geodesic dome portion including a portion of a first polyhedron geodesic dome having a first frequency, said second annular geodesic dome portion comprising a portion of a second polyhedron geodesic dome having a second frequency and said third annular geodesic dome portion comprising a portion of a third polyhedron geodesic dome having a third frequency.

17. The head-protective helmet according to claim 16 wherein said first polyhedron geodesic dome is an octagonal geodesic dome and wherein said first frequency is a frequency of 4, wherein said second polyhedron geodesic dome is an octagonal geodesic dome, and wherein said second frequency is a frequency of 6; and wherein said third polyhedron geodesic dome is an octagonal geodesic dome and wherein said third frequency is a frequency of 8.

18. Head-protective helmet, comprising:

a geodesic dome, said geodesic dome defined by a geodesic pattern and being a molded geodesic dome having an inner surface and an outer surface, said geodesic pattern being molded in said outer surface by embossing to provide said geodesic pattern on said outer surface and said geodesic pattern being molded on said inner surface in intaglia to provide said geodesic pattern on said inner surface in indentation, and said geodesic pattern provided on said outer surface overlying said geodesic pattern provided on said inner surface.

* * * * *